US007028864B2

(12) United States Patent
McCann et al.

(10) Patent No.: US 7,028,864 B2
(45) Date of Patent: Apr. 18, 2006

(54) BAR GUN

(75) Inventors: Gerald P. McCann, Los Angeles, CA (US); Leonid Zatulovsky, Northridge, CA (US); Donald J. Verley, Lake Hughes, CA (US)

(73) Assignee: McCann's Engineering & Mfg. Co., Los Angeles, CA (US)

( * ) Notice: Subject to any disclaimer, the term of this patent is extended or adjusted under 35 U.S.C. 154(b) by 329 days.

(21) Appl. No.: 10/429,894

(22) Filed: Apr. 30, 2003

(65) Prior Publication Data

US 2004/0217131 A1 Nov. 4, 2004

(51) Int. Cl.
*B67D 5/06* (2006.01)

(52) U.S. Cl. ..... 222/144.5; 222/113; 222/132; 222/146.6

(58) Field of Classification Search ..... 222/146.1, 222/132, 146.6, 129.1, 129.2, 129.4, 113, 222/144.5; 62/389, 390
See application file for complete search history.

(56) References Cited

U.S. PATENT DOCUMENTS

| | | | | |
|---|---|---|---|---|
| 3,168,967 A | | 2/1965 | Giampa | 222/129.1 |
| 3,241,720 A | * | 3/1966 | Barney | 222/23 |
| 3,863,810 A | * | 2/1975 | Hanson | 222/129.1 |
| 4,162,028 A | | 7/1979 | Reichenberger | 222/129.4 |
| 4,497,421 A | | 2/1985 | Schilling | 222/144.5 |
| 4,619,378 A | | 10/1986 | de Man | 222/144.5 |
| 4,673,108 A | * | 6/1987 | de Man | 222/144.5 |
| 4,921,140 A | * | 5/1990 | Belcham | 222/144.5 |
| 4,986,449 A | | 1/1991 | Valiyee et al. | 222/144.5 |
| 5,042,692 A | | 8/1991 | Valiyee et al. | 222/144.5 |
| 5,056,686 A | * | 10/1991 | Jarrett | 222/129.2 |
| 5,192,003 A | * | 3/1993 | Billings | 222/129.1 |
| 5,251,790 A | * | 10/1993 | Cohn et al. | 222/146.6 |
| 6,725,687 B1 | * | 4/2004 | McCann et al. | 62/389 |

FOREIGN PATENT DOCUMENTS

EP 0 307 150 3/1989

OTHER PUBLICATIONS

U.S. Appl. No. 10/237,165, filed Sep. 6, 2002.

* cited by examiner

*Primary Examiner*—Frederick C. Nicolas
(74) *Attorney, Agent, or Firm*—Connolly Bove Lodge & Hutz LLP

(57) ABSTRACT

A bar gun includes a housing assembly with valve seats, separate inlets to those seats and separate outlets from those seats. Valve elements are operatively mounted to the housing to cooperate with the valve seats. Actuators are pivotally mounted relative to the housing assembly to provide two valve actuations per actuator. A bar gun handle is arranged relative to the actuators to improve access to the actuator levers. A low-current electro-luminescent element is arranged behind a light-transmitting cover to improve visibility of labeling on the gun. Actuator bars are pivotally mounted below valve lifters on the actuators. Syrup valve elements and carbonated and noncarbonated water elements are located below the actuator bars to be actuated by the actuator bars to create the appropriate mix. Lost motion is provided between the actuator bars and the syrup valve elements to accommodate differentials in pressures between the waters and the syrups. The connector to the bar gun includes equal length supply tubes contained within a sheath. The tube end pieces at either end include grouped hole patterns. Shut off valves are employed at the tube end piece at the supply end of the connector which close the supply passages when the end piece is removed. Manual valves are also available to shut off individual supply lines.

42 Claims, 11 Drawing Sheets

BAR GUN

BACKGROUND OF THE INVENTION

The field of the present invention is apparatus for dispensing beverages and, in particular, handheld bar guns for dispensing a number of different beverages from the same device.

Bar guns that provide an operator with the ability to dispense a number of different beverages by selecting among buttons are common in the bar service industry. Typical mechanical handheld bar guns have valves that dispense pressurized liquid through a discharge spout when an appropriate button is depressed. Each valve normally has a valve seat including an O-ring, a valve element and a retainer spring that holds the valve element biased against the seat. The button is depressed with sufficient force to overcome the spring force closing the valve to dispense liquid. Once the valve is open, the pressurized liquid flows through the valve and out of the discharge spout into, for example, a glass for serving. Typically the bar gun is supplied with syrup, carbonated water and noncarbonated water. A single button is commonly linked mechanically to both a syrup valve and either a carbonated water valve or a non-carbonated water valve to simultaneously dispense two liquids to obtain an appropriate mixture thereof.

Prior bar guns have been designed with one button for each beverage selection with multiple of the buttons depressing either the same carbonated or non-carbonated water valve. Early on, bar guns typically had four buttons for four different beverages and the handling thereof was reasonably manageable. More recently, however, greater numbers of carbonated and noncarbonated fruit, tea and other flavored beverages have become popular. As a result, the present-day bar gun commonly has eight to fourteen buttons. To accommodate the additional buttons, bar guns have grown larger and bulkier.

The size of the current bar guns create handling problems. For example, an operator oftentimes must adjust hand positions to depress the appropriate buttons for dispensing different beverages. Such adjustments make one-hand operation more difficult. Further, with greater numbers of women in the bar service industry today, it is not uncommon for the operator to use both hands to operate a bar gun. To further complicate use, a typical bar gun has buttons which are quite close together. This is to provide the selection now demanded. The operator must take care not to accidentally depress more than one button. Even so, the reach required to cover all of the buttons additionally can cause multiple buttons to be pushed.

Another common problem associated with conventional mechanical bar guns is the poor visibility of the buttons and the identification of the beverage associated with those buttons. Decals have been positioned atop or adjacent to the buttons for identification. However, bar guns are typically used in poorly lit environments, such as in bars or nightclubs, where decals have limited effectiveness. In an attempt to overcome this problem, some bar guns have employed larger buttons and larger decals. However, using large buttons usually results in reducing the spacing between buttons. Again, it becomes difficult to avoid depressing more than one button at a time.

Typical bar gun installations provide carbonated water at approximately 100 psi. This may also be true for the noncarbonated water. The syrup, on the other hand, is provided at a lower pressure, that of 50 to 60 psi. This disparity in pressure and mechanical linkage issues can result in the tendency that the syrup valve opens before the water valve. Therefore, unless the operator rapidly presses the bar gun button, an excessive amount of syrup can be dispensed. This tendency to bleed syrup before the water valve is opened also can impact on the taste where adjacent buttons are partially open due to the arrangement of the buttons as discussed above.

SUMMARY OF THE INVENTION

The present invention is directed to an improved bar gun having a housing assembly with valve seats, separate inlets to those seats and separate outlets from those seats. Valve elements are operatively mounted to the housing to cooperate with the valve seats. Convenient actuators are employed to accomplish accurate dispensing of beverages.

In a first separate aspect of the present invention, the actuators are pivotally mounted relative to the housing assembly with each actuator operatively coupled with a separate pair of the valve elements. Each pivotally mounted actuator provides a first, pivoted position opening a first of the valves, a second, pivoted position opening a second of the valves and a third, at rest position with neither of the valves open. Such an actuator can replace two buttons on a conventional bar gun and can increase the accuracy of operation. As with conventional bar guns, the actuators may be mechanically coupled to open two valves, one syrup valve and one water valve, either carbonated or noncarbonated, to dispense an appropriate drink mix.

In a second separate aspect of the present invention, the actuators are pivotally mounted with the pivot mounts lying substantially in a plane. The bar gun further includes an elongate handle inclined to the housing assembly extending on the same side of the pivot axes plane as the actuators. The elongate handle may be inclined at approximately 60° from perpendicular to the plane of the pivot axes. The actuators may then be pivoted toward and away from the elongate handle to open different valve elements more conveniently and more accurately.

In a third separate aspect of the present invention, a low-current electro-luminescent element surrounds the actuators. Such an element may also illuminate one end of the housing assembly opposed to the bar gun handle. This element may be a sheet. Light-transmitting covers may be fixed to the housing assembly over the luminescent elements.

In a fourth separate aspect of the present invention, an actuator bar is operatively coupled with the actuator and the valves in the housing assembly. A water valve element, either carbonated or noncarbonated, and syrup valve element are operatively coupled with the actuator bar on one side of the actuator bar and the actuator is operatively coupled with the actuator bar on the opposite side of the actuator bar. The operative coupling between the actuator bar and the syrup valve element provides for lost motion such that the water valve element will reach the point of opening when the more easily opened syrup valve element is engaged. The actuator bar may be pivotally mounted within the housing assembly. The syrup valve element may be between the pivot mounting and the water valve element to give greater throw to the water valve element.

In a fifth separate aspect of the present invention, the bar gun includes a tube end piece fixed to the housing assembly and a flow valve assembly remote from the tube end piece. The tube end piece has a first pattern of tube fittings and the valve assembly has a second pattern of tube fittings, both the first and second patterns being grouped to provide for equal length tubing in a conventional bar gun tube sheath. This allows movement of the bar gun without experiencing torque loads from associated tubes and tube sheaths as the bar gun is moved about.

In a sixth separate aspect of the present invention, any of the foregoing separate aspects are contemplated to be combined for greater advantage.

Accordingly, it is an object of the present invention to provide an improved bar gun drink dispensing system. Other and further objects and advantages will appear hereinafter.

DETAILED DESCRIPTION OF THE PREFERRED EMBODIMENTS

Figure 13:
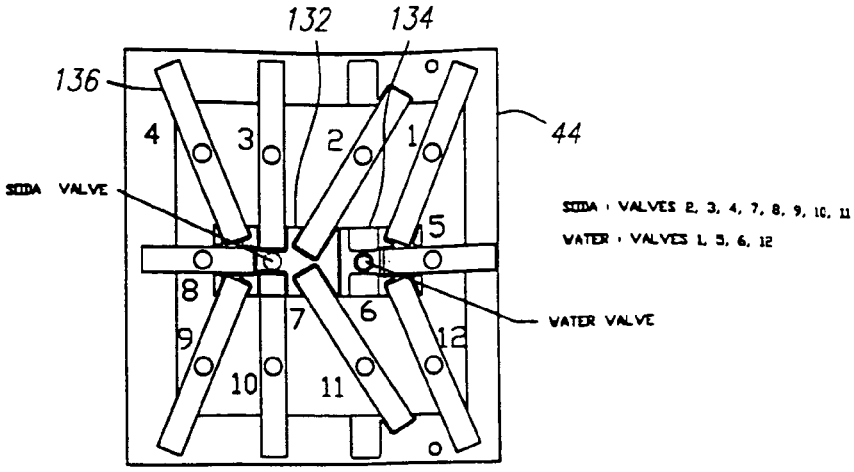
FIGS. 13 through 15 are actuator bar and valve element layouts for a six actuator bar gun.
Figure 14:
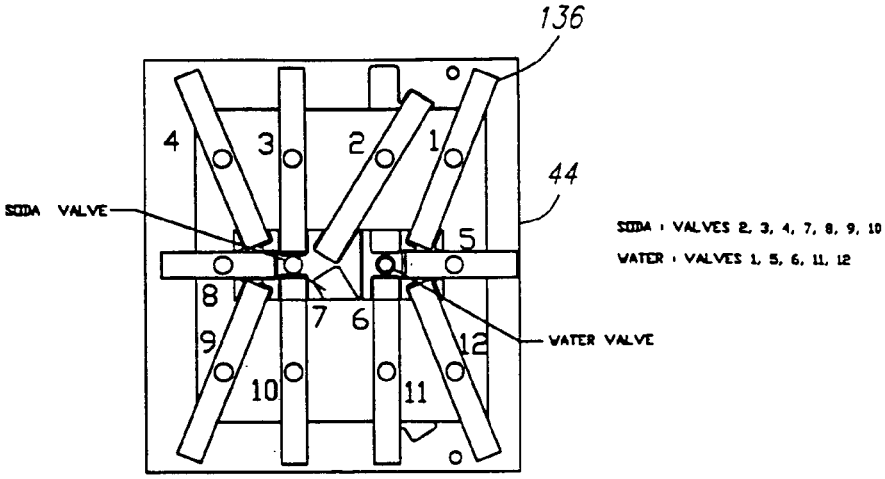
Figure 15:
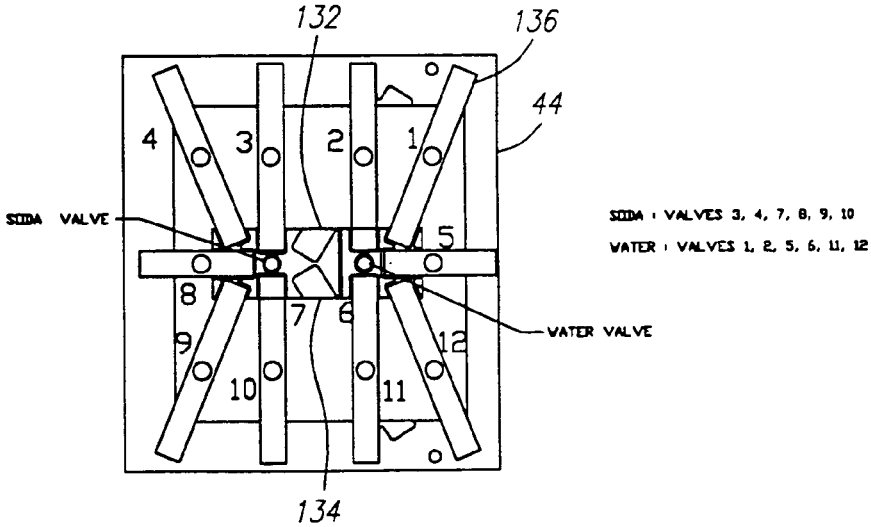
Figure 16:
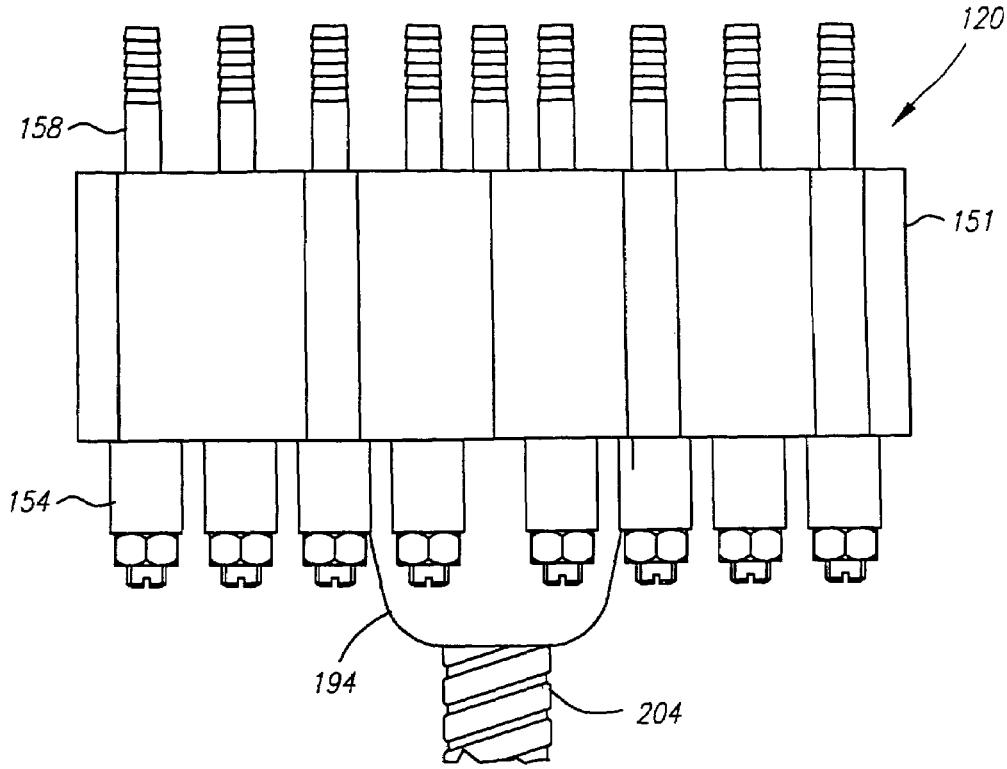
FIG. 16 is a plan view of a valve assembly.

Turning in detail to the drawings, a bar gun embodiment is shown to include four actuators. Any reasonable number of actuators may be employed and the layout of a second embodiment having six actuators is illustrated in the patterns of FIGS. 13 through 15. But for the number of actuators, associated valves and valve components and the accommodation thereof, there are no differences between embodiments having different numbers of actuators.

A housing assembly, generally designated 30, is conveniently fabricated of an upper piece 32 and a lower piece 34. The upper piece 32 includes an upper portion of an elongate handle 36 and a mounting plate 38. The lower piece 34 includes a lower portion of the elongate mounting handle 36 and a spout support 40 with a spout manifold 42 depending therefrom. A valve block 44, positioned between the mounting plate 38 and the spout support 40 also is part of the housing assembly 30. These three principal components, the mounting plate 38, the spout support 40 and the valve lock 44, define the operative housing assembly. The upper and lower pieces 32, 34 also extend to define the elongate handle 36. Fasteners 46 are employed to retain these three parts together.

The mounting plate 38 includes rectangular holes therethrough. There are four such rectangular holes 48 in the pattern as shown. Any reasonable number of holes 48 and patterns of holes may be employed. These holes define pivot mounts with pivot elements 50 extending across the rectangular holes 48. The axes of these elements 50 lie substantially in a plane within the mounting plate 38.

The elongate handle 36 defined by portions of the upper piece 32 and lower piece 36 is substantially hollow with a tube passage 52 therethrough. An access port 54 is provided at one end of the tube passage 52. The elongate handle is somewhat arcuate in overall configuration with a symmetrical vertical plane. Adjacent the mounting plate 38, the elongate handle 36 extends at approximately 60° from the perpendicular to the plane of the axes of the pivot elements 50. This orientation and form provides a comfortable grip and improved access to the controls for the thumb or finger of an operator gripping the elongate handle 36.

Figure 1:
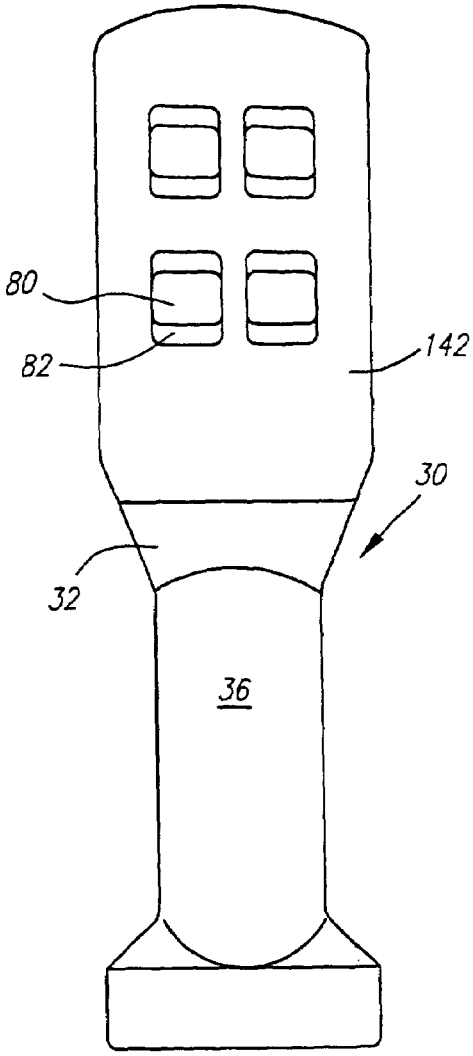
FIG. 1 is a top view of a four actuator bar gun.
Figure 4:
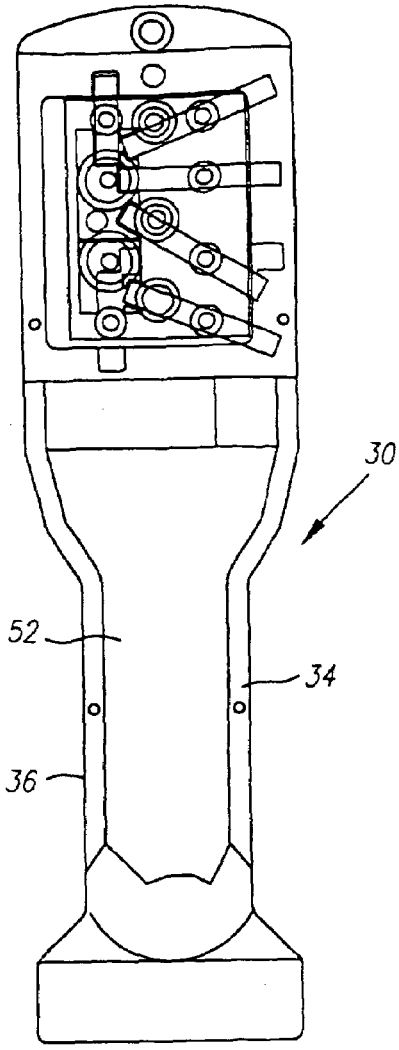
FIG. 4 is a cross-sectional view taken along line 4—4 of FIG. 3.
Figure 2:
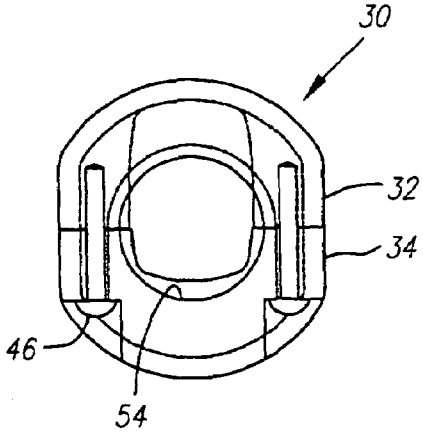
FIG. 2 is a proximal end view of the bar gun without the conduit assembly.
Figure 5:
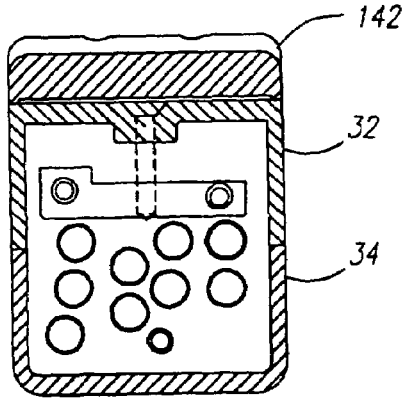
FIG. 5 is a cross-sectional view taken along line 5—5 of FIG. 3.
Figure 3:
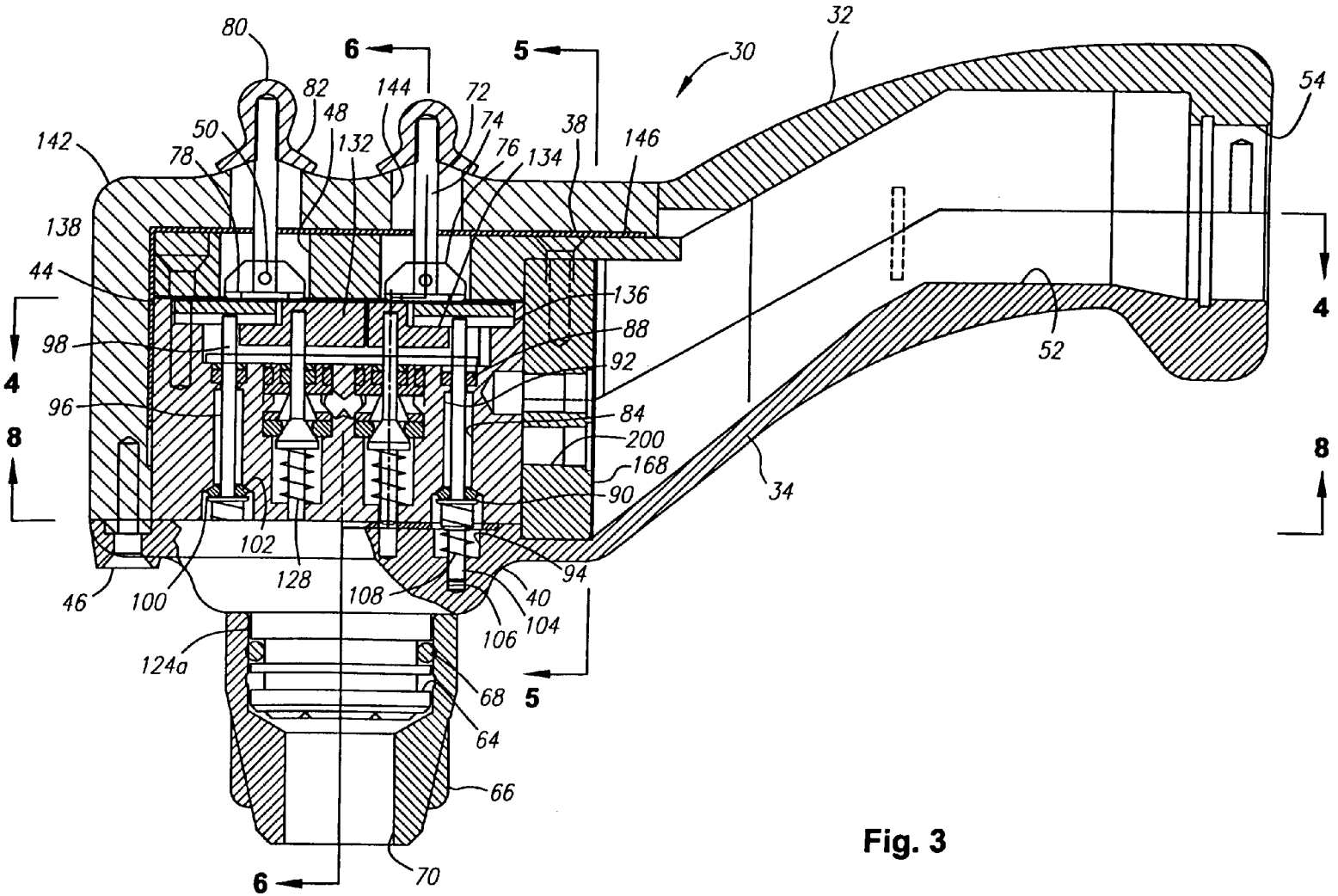
FIG. 3 is a side view of the bar gun in cross section taken along line 3—3 of FIG. 1.
Figure 6:
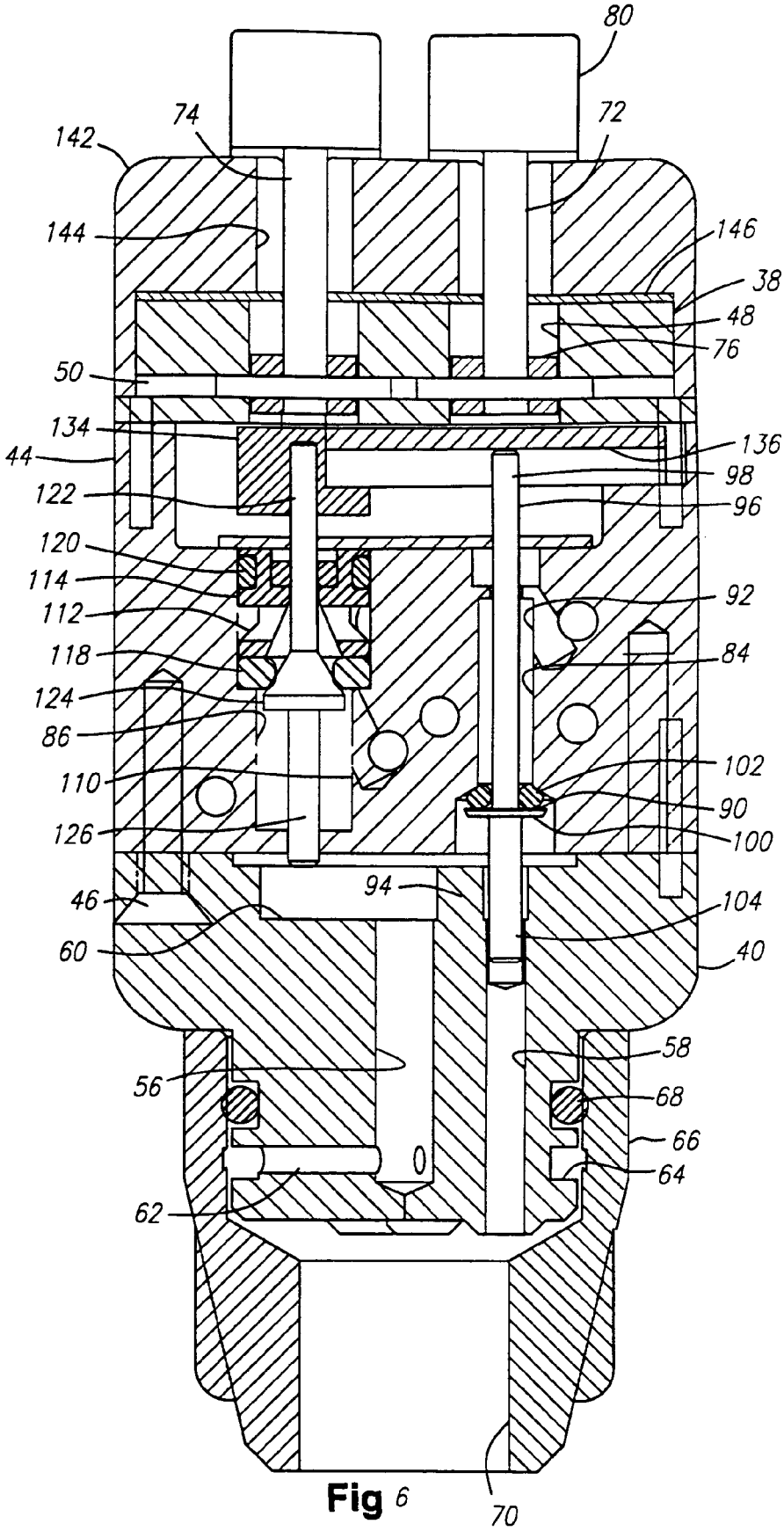
FIG. 6 is a cross-sectional view taken along line 6—6 of FIG. 3.
Figure 7:
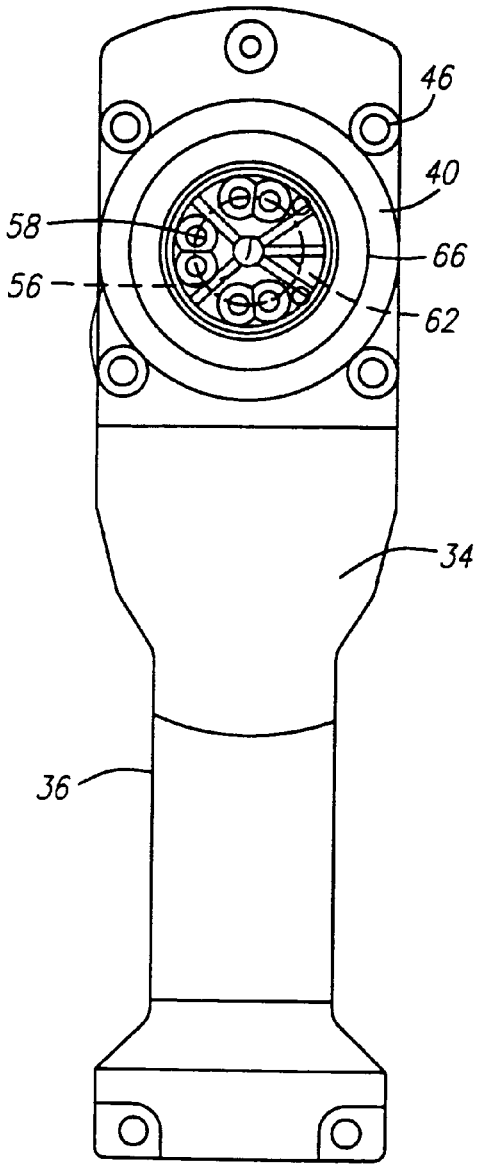
FIG. 7 is a bottom view of the bar gun.
Figure 8:
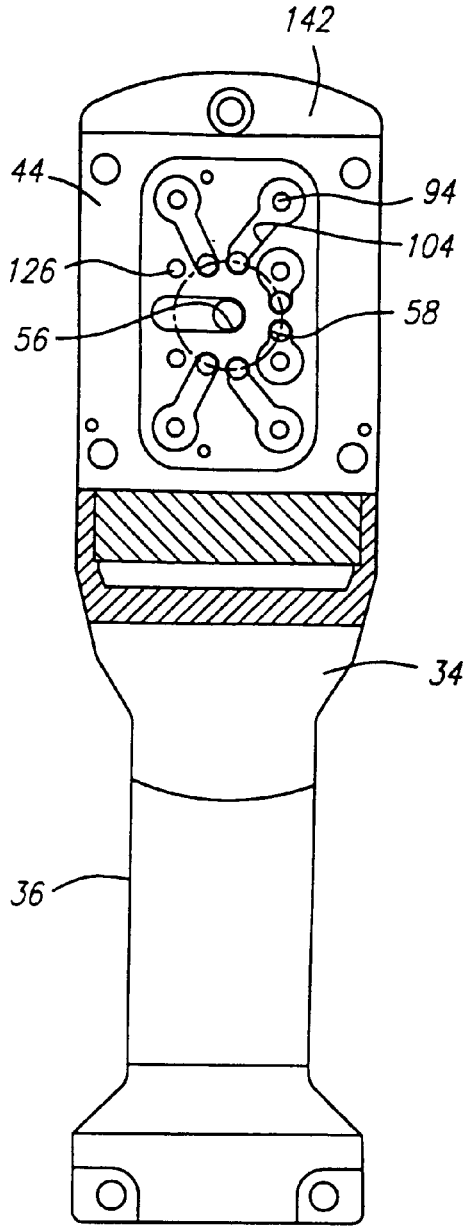
FIG. 8 is a cross-sectional view taken along line 8—8 of FIG. 3.

The spout support 40 with the spout manifold 42 depending therefrom are oriented at the opposite side of the valve block 44 from the mounting plate 38. The spout manifold 42 provides a block with a water passage 56 and syrup passages 58 extending therethrough. A water collector passage 60 is in communication with both the carbonated and noncarbonated passage from the valve block 44 as carbonated water and regular water are typically not distributed simultaneously. The term "water" without a modifier is used here without distinction as to the level of carbonation, if any. The water passage 56 then extends from the water collector passage 60 partially through the spout manifold 42, as best seen in FIG. 6. Multiple lateral passages 62 extend therefrom to an annular channel 64 for release of one or the other of the carbonated water and noncarbonated water. The syrup passages 58 extend downwardly to the lower surface of the spout manifold 42 for supply of syrup to the spout.

A spout 66 is retained about the spout manifold 42. An O-ring 68 seals the spout 66 with the spout manifold 42 above the distribution points for the water. The spout 66 also fits with a small clearance around the spout manifold 42 below the annular channel 64 so that pressurized carbonated water will be diffused into the spout 66. The spout 66 includes a mixing bore 70 receiving the diffused carbonated water or noncarbonated water and the syrup for controlled release into a glass.

The mounting plate 38 includes actuators 72 extending into the rectangular holes 48 and pivotally mounted to the pivot elements 50. The actuators 72 each include a lever 74 extending upwardly from the mounting plate 38. The actuators 72 each further include base elements 76 into which the associated levers 74 extend. The levers 74 and the base units 76 pivot together about the pivot elements 50 to define a first, pivoted position as illustrated toward the left end of FIG. 9. A second, pivoted position would have the same lever 74 shown in the first, pivoted position to be inclined equally in the other direction. A third, at rest position is illustrated by the lever 74 to the right of the inclined lever 74 in FIG. 9. The base elements 76 are shown to have valve lifters 78 displaced laterally to either side of the pivot elements 50. In this way, each actuator 72 includes a pair of lifters 78. The lifters 78 may be specific blocks slightly rounded to better receive pressure as the actuator 72 is pivoted or may simply be edges of the base element 76 to provide a less elegant solution. Finally, the levers 74 include caps 80 with skirts 82 to press against the assembly for loosely sealing the assembly about the levers 74.

The valve block 44 of the housing assembly 30 includes a plurality of syrup valve chambers 84. With four actuators, there are six syrup valve chambers 84. Two water valve chambers 86 are also provided. One of the water valve chambers 86 is used for carbonated water while the other water valve chamber 86 is used for noncarbonated water. The presence of six syrup valve chambers 84 and two water valve chambers 86 contemplates that two of the actuators 72 will be employed for the dispensing of carbonated water and noncarbonated water without syrup.

The syrup valve chambers 84 include a seal 88 at the upper end, a valve seat 90, separate inlets 92 and separate outlets 94. The separate inlets 92 include passages from the right side of the valve block 44 to each of the syrup valve chambers 84 above the valve seats 90. Such separate inlets 92 are illustrated in FIG. 6. The separate outlets 94 are located in the syrup valve chambers 84 below the valve seats 90. These separate outlets 94 are in communication with the syrup passages 58 extending through the spout manifold 42.

Syrup valve elements 96 extend longitudinally through the syrup valve chambers 84. These valve elements 96 include a push rod 98 extending through the seal 88 and toward the top of the valve block 44. A valve body 100 is fixed with the push rod 98 and provides a retainer for an O-ring 102 which cooperates with the valve seat 90 to control flow through the valve. A guide rod 104 extends from the valve body 100 to be retained within a guide hole 106. A valve spring 108 is positioned to operate between the valve body 100 and the spout support 40 within the separate outlet 94 to bias the syrup valve toward the closed position. The separate inlet 92 to each of the syrup valve chambers 84 extends to the area of the chamber above the valve body 100.

Each of the water valve chambers 86 includes a separate inlet 110 and a separate outlet 112. The inlet 110 communicates with the water valve chamber 86 from below and the outlet 112 extends from above and then downwardly to the water collector passage 60. An insert 114 provides an annular outlet for the water to progress to the separate outlet 112. A valve seat 118 is positioned below the insert 114 within the water valve chamber 86. This valve seat 118 is provided by an O-ring.

Each water valve includes a water valve element 120, one being a carbonated valve element 120 while the other is a noncarbonated valve element 120. The valves are shown here to conveniently be identical. These elements also include a push rod 122 extending upwardly to cooperate with the actuators 72. A conical valve body 124 cooperates with the valve seat 118. A guide rod 126 extends from the other side of the valve body 124 and is retained in a hole within the valve block 44. A valve spring 128 biases the valve body 124 toward the seat 118. An O-ring seal 130 is located around the push rod 122 to contain the pressurized flow. The carbonated and noncarbonated water valves open against the standing pressure within the system unlike the syrup valves which open with the standing pressure. The water pressure on these valves is about 100 psi while that of the syrup is about 50 psi.

Linkage systems are presented between the actuators 72 and the push rods 98 and 122 to operatively couple the actuators 72 with the valve elements 96 and 120. Actuation plates 132 and 134 are mounted to the push rods 122 to move therewith. These plates 132 and 134 each have portions extending upwardly to meet one of the valve lifters 78 of the actuators 72. The respective valve lifters 78 bear directly on these portions to create a physical link between the actuators 72 and the corresponding valve elements 120. The actuation plates 132 and 134 are otherwise relieved to stand away from the valve lifters 78 and the mounting plate 38. All of the syrup valve elements 96 are displaced from the bottom of the mounting plate 38.

Figure 9:
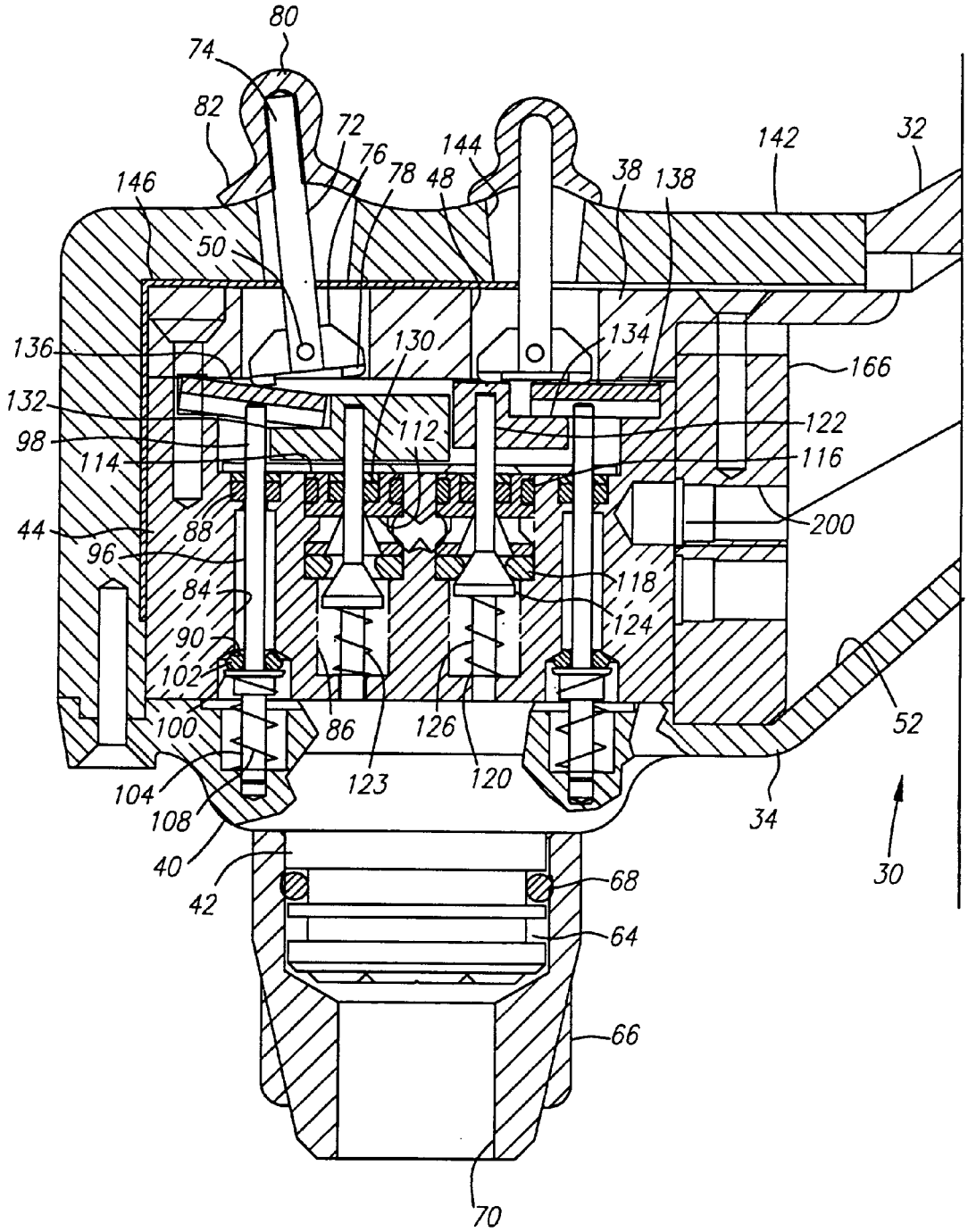
FIG. 9 is a detail of the cross-sectional view as seen in FIG. 3.
Figure 10:
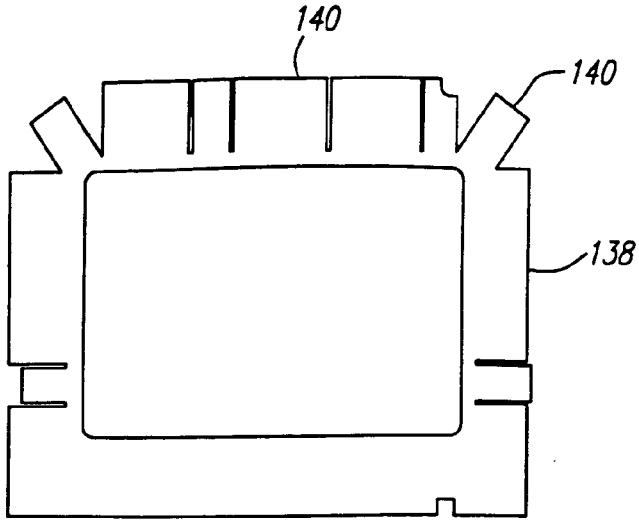
FIG. 10 is spring plate for the four actuator bar gun.

Actuator bars 136 are shown to be located between the syrup valve elements 96 and the mounting plate 38 as well as between the activation plates 132 and 134 and the mounting plate 38. These actuator bars 136 are channels into which the push rods 98 extend. The actuator bars are shown to be captured between the valve block 44 and the mounting plate 38 to create a pivot mount. A spring plate 138 provides leaf springs 140 which bias the actuator bars toward closure of the valves. The valve lifters 78 are found on one side of the actuator bars 136 while the syrup valve elements 96 and the actuation plates 132 and 134 are found on the other side of the actuator bars 136. As the actuator bars 136 are effectively pivotally mounted, there are cooperative couplings between the actuators 72 and the syrup valve elements 96 and the water valve elements 120. In FIG. 9, an actuator 72 is illustrated in the first position. In this position, the actuator bar 136 is pivoted to push down on the actuation plate 132 and one of the syrup valve elements 96. As such, both the water valve and the syrup valve are opened for flow of material to the spout 66.

The linkage between the actuator 72 and the valve elements 96 and 120 is arranged to accomplish a careful proportioning of the dispensed liquids in spite of the pressure differentials between the water pressures at approximately 100 psi and the syrup pressures at approximately 50 psi. To achieve this consideration, the syrup valve elements 96 are located between the pivot supports for the actuator bars 136 and the water valve elements 120. This arrangement dictates that the water valve elements 120 experience greater movement for a given movement of the actuators 72 than is experienced by the syrup valve elements 96. As the water valve elements are more resistant to opening, this added displacement insures rapid operation. Further, the syrup valve elements 96 are displaced in the rest position from the actuator bars 136. Consequently, as the actuators 72 begin to operate, they will first stress against the water valve elements 120 before encountering the less resistant syrup valve elements 96 because of the lost motion therebetween. In this way appropriate initiation and proportional dispensing is achieved.

A light-transmitting cover 142, having a top and three sides, is positioned over the mounting plate 38 and the valve block 44. The spout support 40 extends outwardly beyond the valve block 44 to finish off the edge of the surrounding light-transmitting cover 142. This cover 142 includes holes 144 rectangular in cross section to accommodate the actuators 72 as did the mounting plate 38. A low-current electroluminescent element 146 formed as a sheet is positioned above the mounting plate 38 and under the top of the light-transmitting cover 142. The element 146 is in the form of a thin sheet coupled by low-current wire with a remote transformer. This illuminating element 146 may extend down the front of the valve block 44 beneath the front portion of the cover 142. Translucent advertising indicia may be employed on the front surface of the cover while actuator labels and the like may be incorporated into the top of the cover 142. Alternatively, low-current electro-luminescent wires can be disposed about the space between the mounting element 38 and the light-transmitting cover 142 to the same effect. Thus, the illuminating element or elements 146 can provide for readable labeling of the actuators 72.

The illuminating element 146 has a finite life. To insure that the element 146 lasts a reasonable amount of time and possibly as long as the bar gun itself, a switch may be placed at the bar gun hanger at the installation in the bar or other service facility. Such a switch (not shown) may be a proximity switch or mechanical switch to control power to the illuminating element 146. When the bar gun is lifted from the hanger, the switch provides power from the transformer to the illuminating element 146. Upon replacement in the hanger, power is terminated.

Having now described the embodiment of the bar gun as represented in FIGS. 1 through 12 with four actuators 72, other embodiments with additional actuators are considered. When there are six actuators 72 rather than four, twelve selections rather than eight are provided. Yet, only one carbonated water selection and one noncarbonated water selection are necessary. Consequently, four additional syrup selections are available. The sixth actuator configurations shown in FIGS. 13 through 15 continue to consist of two rows. As such, the operator is still able to easily reach all of the actuators 72. The housing assembly is otherwise wider to accommodate the additional actuators and valves. It otherwise consists of identical components.

Figure 11:
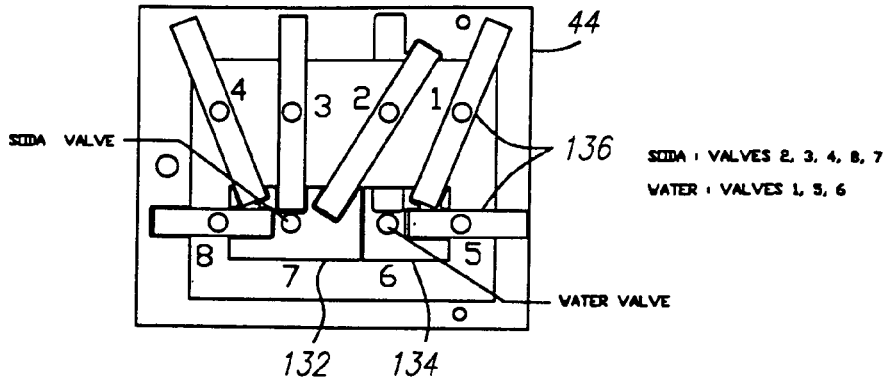
FIGS. 11 and 12 are actuator bar and valve element layouts for a four actuator bar gun.
Figure 12:
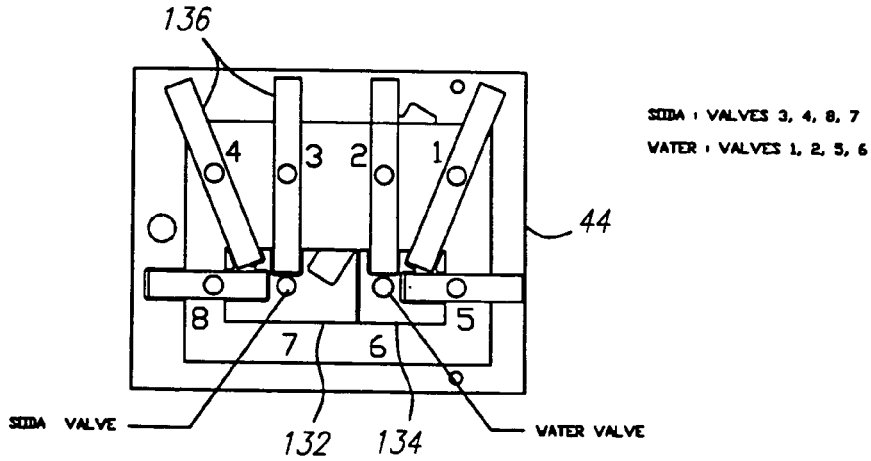

FIGS. 11 through 15 illustrate the plurality of valve layouts that may be accomplished through repositioning or replacement of the actuator bars 136. In FIG. 11, the actuator bars are arranged such that syrup valve stations 2, 3, 4 and 8 are operatively coupled with the carbonated water valve which is also available by itself at station 7. Two syrup valves at stations 1 and 5 are associated with the noncarbonated water valve which is also independently operable at station 6. In FIG. 12, three syrup valves are operatively coupled with each of the carbonated water valve and the noncarbonated water valve. Similarly, in FIG. 13, a twelve-valve bar gun is illustrated with syrup dispensed with carbonated water at stations 2, 3, 4, 8, 9, 10 and 11 with carbonated water separately dispensed at station 7. The noncarbonated water is dispensed with syrup at stations 1, 5 and 12 and separately dispensed at station 6. In FIG. 14, the arrangement is changed to give four noncarbonated drinks and six carbonated drinks. Finally, in FIG. 15, the carbonated drinks and the noncarbonated dirnks are split at five apiece, again with dispensing of carbonated water at station 7 and noncarbonated water at station 6 independently of the syrups.

In FIGS. 16 through 20, a valve assembly, generally designated 150, is illustrated. The valve assembly 150 is located remotely from the bar gun itself, typically under the bar for which there is mounting plate 151. The assembly 150 includes a flow control valve block 152 having conventional flow control valves 154 positioned within chambers 156. The chambers 156 are arranged conveniently and to accommodate separate inlet supply passages 158 from sources of syrups, carbonated water and noncarbonated water (not shown). For ease of manufacture, a manifold block 159 is separately fabricated from the flow control valve block and assembled therewith with seals at the part line for passages therethrough.

Ball valves 160 provide a manual means for terminating flow of any source product. These valve 160 are preferably marked to correspond to the markings on the gun to identify the corresponding valves. Leaks and sticking valves can be immediately shut down with these valves 160.

Figure 17:
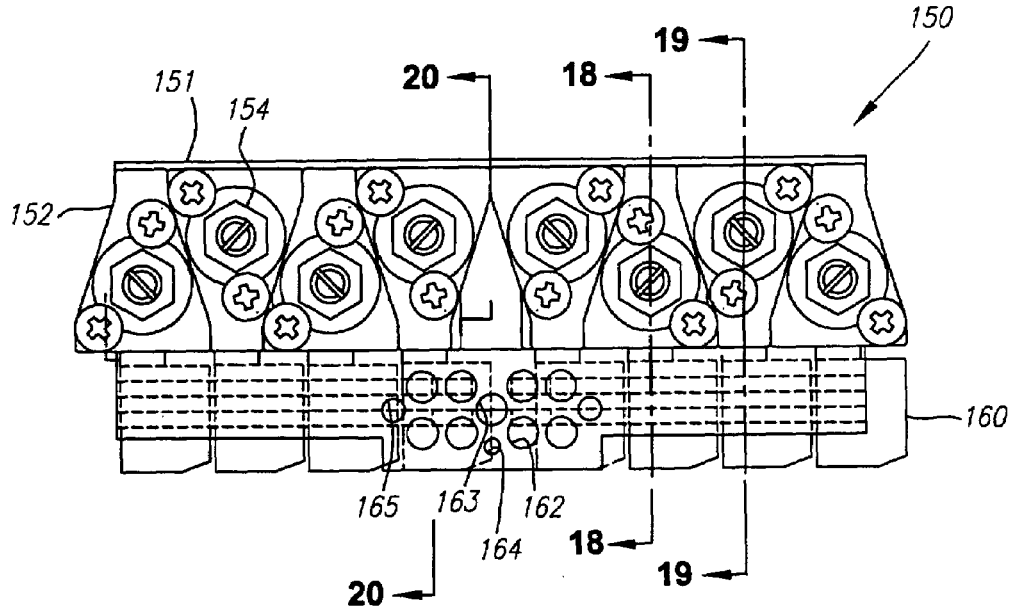
FIG. 17 is a front view of the valve assembly.
Figure 18:
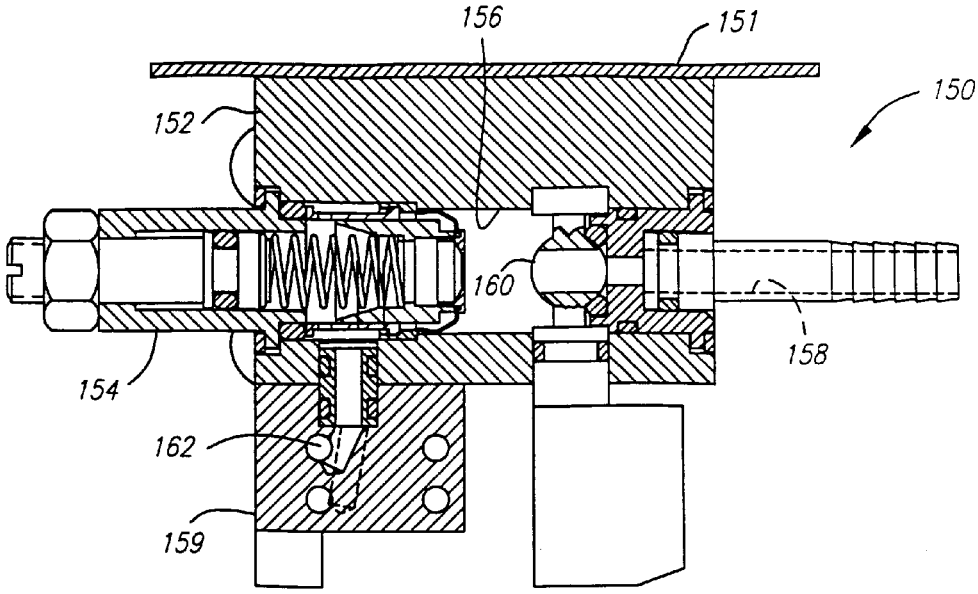
FIG. 18 is a cross-sectional view taken along line 18—18 of FIG. 17.
Figure 22:
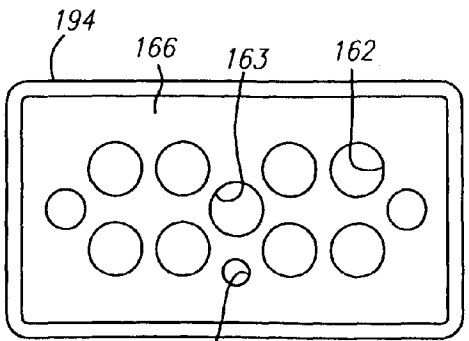
FIG. 22 is a back view of the valve assembly tube end piece of FIG. 21.

Separate outlet supply passages 162 extend from the chambers 156 through the flow control valve block 152 and the manifold block 159 to define a pattern at the side of the flow control valve block 152 grouped for passage through a sheath to the bar gun. This pattern is best illustrated in FIGS. 17 and 22.

Figure 21:
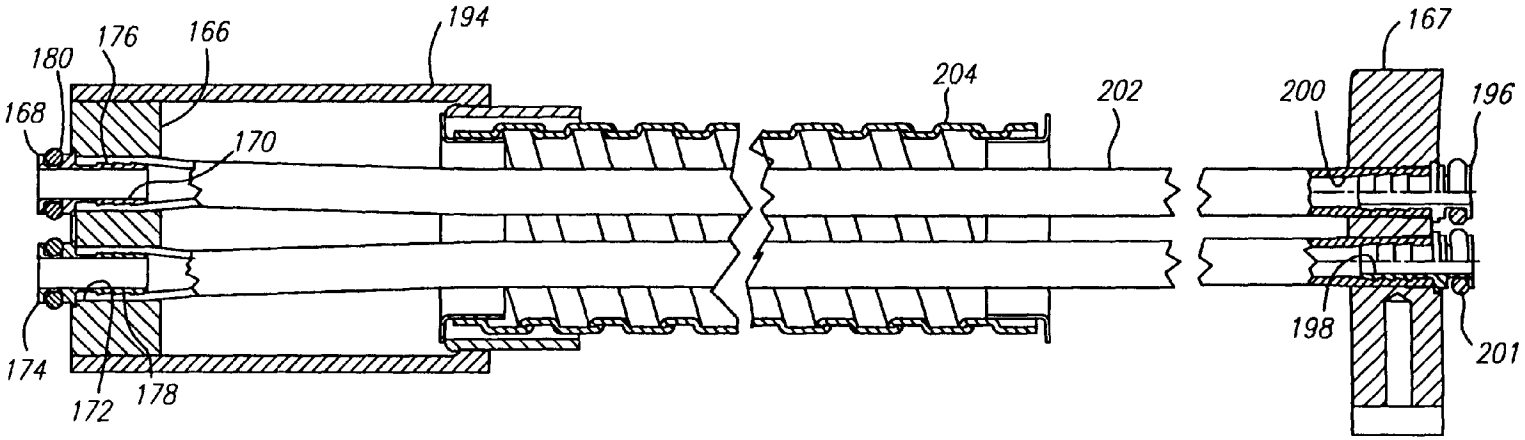
FIG. 21 is a side view in cross section of a tube sheath and representative tubes therein.
Figure 23:
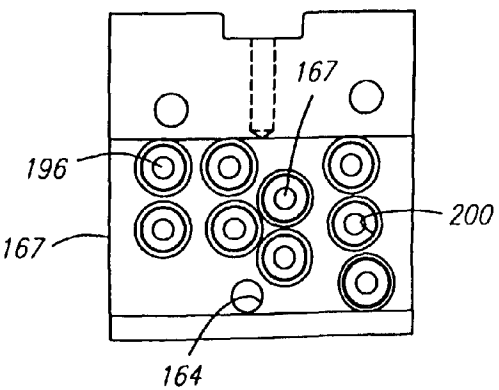
FIG. 23 is a back view of the bar gun tube end piece of FIG. 21.

Communication between the valve assembly 150 and the bar gun includes individual tubes for each of the supply products. Also, a low-current wire for the illuminating elements 146 would communicate with a transformer remotely mounted. Where practical, a return conduit for recirculating carbonated water and a shunt at the bar gun between the supply and the return provide communication for cold carbonated water to be present at the gun itself on a constantly circulating basis. Reference is made regarding recirculation to U.S. patent application Ser. No. 10/237,165, filed Sep. 6, 2002 for a DRINK DISPENSING SYSTEM, the disclosure of which is incorporated herein by reference. To this end, a conduit assembly is provided as best illustrated in FIGS. 21, 22 and 23. These utilities communicated through the conduit are reflected in the outlet supply passages 162, the return passage 163 and the wire conduit passage 164 in the valve assembly 150. Mounting holes 165 for studs (not shown) to retain the assembly are also found in the face of the valve assembly. There are eight outlet supply passages 162 to accommodate the four actuator bar gun, providing carbonated water, noncarbonated water and six syrup supplies. The return passage 163 is straight through to a circulation system. The conduit passage 164 is also straight through for the wire to be coupled with a transformer (not shown).

Figure 19:
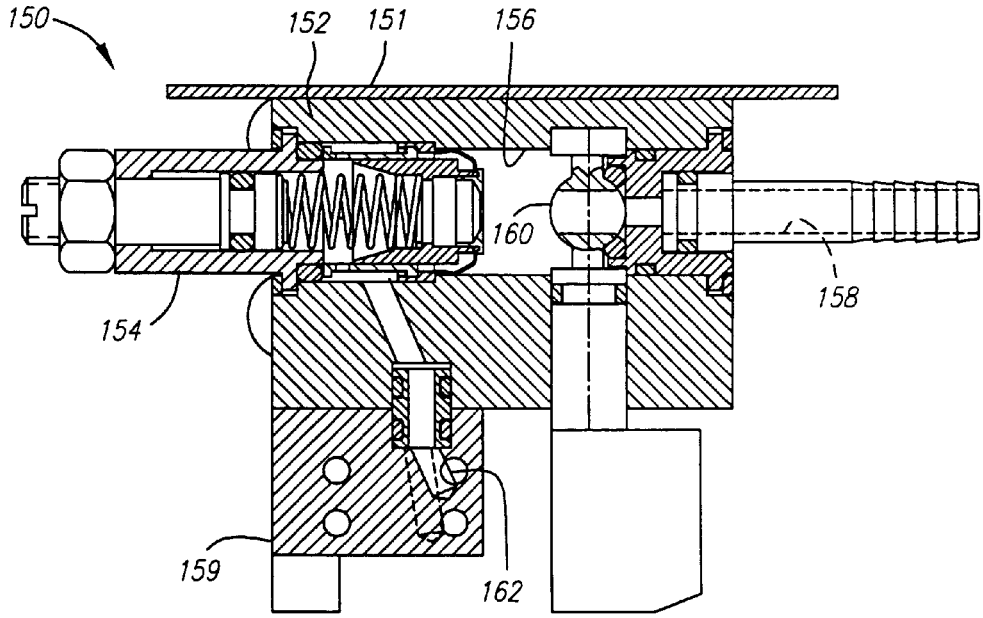
FIG. 19 is a cross-sectional view taken along line 19—19 of FIG. 17.
Figure 20:
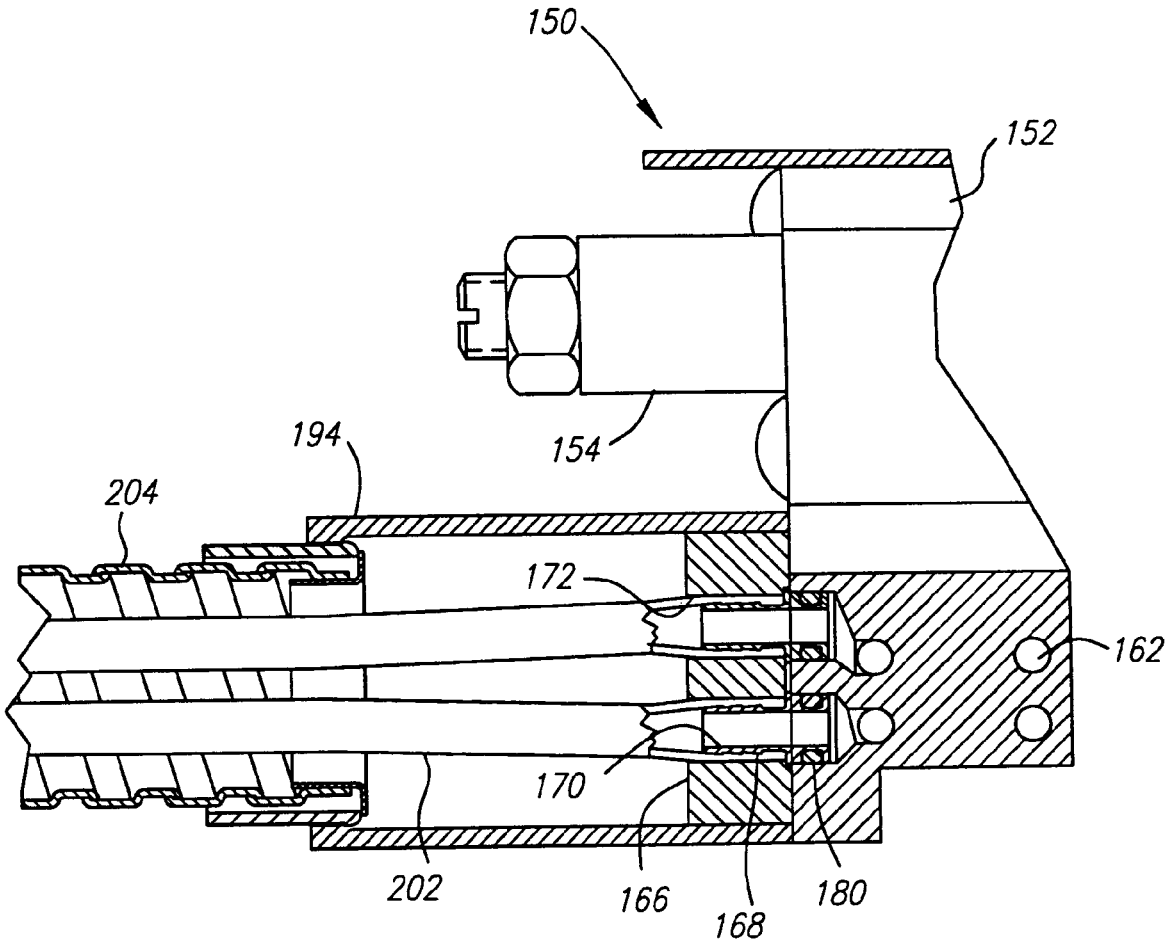
FIG. 20 is a cross-sectional view taken along line 20—20 of FIG. 17.

A valve assembly tube end piece 166 is mounted to the valve assembly 150 in FIG. 19. A bar gun tube end piece 167 is illustrated associated with the valve block 44 in FIG. 9. The sides of these tube end pieces 166 and 167 mating with the valve block 44 and the flow control valve block 152, respectively, are illustrated in FIGS. 21 and 22. As can be seen from a comparison of these Figures, the patterns of holes for tube connections are shown to each be in a grouped pattern with no hole or holes significantly displaced from the group as would happen if the pattern was of rows.

Tube fittings 168 having passages 170 therethrough are positioned in the holes 172 in the tube end piece 166. The holes 172 each include a larger diameter portion in the flow control valve block 152 and a smaller diameter portion extending in the tube end piece 166 with a shoulder in between. The tube fittings 168 also each include a larger portion 174 and a smaller portion 176 with the larger portion 174 extending against the shoulder. The smaller portion 176 includes a tube nipple 178 spaced from the wall of the respective hole to receive a tube. The larger portion 174 includes an O-ring seal 180 located about the fitting 168 to seal the fitting 168.

Two studs (not shown) are fixed in the flow control valve block 152 and extend from the block for mounting the tube end piece 166. Elongate internally threaded caps (not shown) with manually manipulated heads retain the tube end piece 166 on the flow control valve block 152 by being threaded onto the studs. The studs and caps also retain a cover 194 over the tube end piece 166. As such, the caps can be withdrawn and the tube end piece 166 pulled from the flow control valve block 152.

Tube fittings 196 having passages 198 therethrough are positioned in the holes 200 in the bar gun tube end piece 167. The holes 200 in the bar gun tub end piece 166 also extend into the valve block 44 and O-ring seals 201 about the fittings 196 seal within the holes 200.

The conduit assembly extends between the valve assembly and the bar gun. Tubes 202 are securely connected to the fittings 168 and 196. These tubes 202 are all of identical length. A conventional spiral formed flexible sheath 204 covers and constrains the tubes 202 between tube end pieces 166 and 167. By employing fitting patterns with grouped hole patterns at each end and using tubes of equal length, torques tending to twist the bar gun as it is moved about are reduced or eliminated.

Thus, an approved bar gun is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A bar gun comprising a housing assembly including valve seats, separate outlets from the valve seats;

valve elements operatively mounted in the the valve seats, respectively;

actuators pivotally mounted relative to the housing assembly, each actuator operatively coupled with a separate pair of the valve elements and having a first, pivoted position displacing a first of the pair of valve elements from the respective valve seat, a second, pivoted position displacing a second of the pair of valve elements from the respective valve seat and a third, at rest position between the first and second positions with neither one of the pair of valve elements displaced from the respective valve seats.

2. The bar gun of claim 1, at least one of the actuators being operatively coupled with additional of the valve elements such that at least one of the first and second, pivoted positions displaces two valve elements from the respective valve seats.

3. The bar gun of claim 1, the housing assembly further including a pivot mount pivotally mounting each actuator, respectively, each actuator including a lever extending from the housing assembly and two valve lifters displaced laterally to either side of the respective pivot mount.

4. The bar gun of claim 3 further comprising actuator bars in the housing assembly, one of the valve elements being one of a carbonated or noncarbonated water valve element and another of the valve elements being a first syrup valve element, a first one of the actuator bars being pivotally mounted in the housing assembly, the valve element and the syrup valve element operatively coupled with the first actuator bar on one side of the first actuator bar and a first one of the valve lifters being operatively coupled with the first actuator bar on the opposite side of the first actuator bar.

5. The bar gun of claim 4, the syrup valve element being operatively coupled with the first actuator bar between water valve element and the pivotal mounting of the first actuator bar to the housing assembly.

6. The bar gun of claim 5, there being lost motion in the operative coupling between the first actuator bar and the syrup valve element.

7. The bar gun of claim 6 further comprising a plate spring between the first actuator bar and the housing assembly biasing the first actuator bar away from actuation of the water valve element.

8. The bar gun of claim 4 further comprising a first actuation plate between the water valve element and the first actuator bar, the first valve lifter being physically coupled with the water valve element through the first actuator bar and the actuation plate.

9. The bar gun of claim 8, the first valve lifter being physically coupled with the syrup valve element through the first actuator bar.

10. The bar gun of claim 9, a second one of the valve lifters being physically coupled with the actuation plate.

11. The bar gun of claim 4, the syrup valve element being between one of the outlets and one of the valve seats, the water valve element being between one of the inlets and another one of the valve seats.

12. The bar gun of claim 4, another of the valve elements being the other of a carbonated or noncarbonated water valve element and another of the valve elements being a second syrup valve element, a second one of the actuator bars being pivotally mounted in the housing assembly, the carbonated water valve element and the first syrup valve element being operatively coupled with the first actuator bar, the noncarbonated water valve element and the second syrup valve element being operatively coupled with the second actuator bar on one side of the second actuator bar and a second one of the valve lifters being operatively coupled with the second actuator bar on the opposite side of the second actuator bar.

13. The bar gun of claim 12, the second syrup valve element being operatively coupled with the second actuator bar between the noncarbonated water valve element and the pivotal mounting of the second actuator bar to the housing assembly.

14. The bar gun of claim 13, there being lost motion in the operative coupling between the second actuator bar and the second syrup valve element.

15. The bar gun of claim 14, the plate spring being between the second actuator bar and the housing assembly biasing the second actuator bar away from actuation of the noncarbonated water valve element.

16. The bar gun of claim 12 further comprising a second actuation plate between the noncarbonated water valve element and the second actuator bar, the second valve lifter being physically coupled with the noncarbonated water valve element through the second actuator bar and the second actuation plate.

17. The bar gun of claim 16, the second valve lifter being physically coupled with the second syrup valve element through the second actuator bar.

18. The bar gun of claim 17, one of the valve lifters being physically coupled with the second actuation plate.

19. The bar gun of claim 12, the second syrup valve element being between one of the outlets and one of the valve seats, the noncarbonated water valve element being between one of the inlets and another one of the valve seats.

20. The bar gun of claim 1 further comprising a spout coupled with each of the separate outlets;

an elongate handle mounting the housing assembly.

21. The bar gun of claim 20, the pivot axes of the actuators lying in a plane, the elongate direction of the handle being inclined to the plane, the handle and the actuators extending on the same side of the plane.

22. The bar gun of claim 21, the elongate direction of the handle lying at approximately 60 degrees from perpendicular to the plane.

23. The bar gun of claim 20, the first position of each actuator being pivoted away from the elongate handle and the second position of each actuator being pivoted toward the elongate handle.

24. The bar gun of claim 20 further comprising a low-current electro-luminescent element disposed to at least partially surround the actuators on the housing assembly.

25. The bar gun of claim 24, the illuminating element being further disposed to illuminate the housing assembly at a position opposite to the extension of the elongate handle.

26. The bar gun of claim 25 further comprising a light transmitting cover fixed to the housing assembly and covering the illuminating element.

27. A bar gun comprising a housing assembly including at least four valve seats, separate inlets to the valve seats, separate outlets from the valve seats and pivot mounts;

at least four valve elements operatively mounted in the housing assembly and biased against the at least four valve seats, respectively;

actuators pivotally mounted in the pivot mounts, respectively, each actuator including a lever extending from the housing assembly and two valve lifters displaced laterally to either side of the respective pivot mount, each valve lifter operatively coupled with a separate one of the at least four valve elements, each actuator having a first pivoted position displacing a first one of the at least four valve elements from the respective valve seat, a second, pivoted position displacing a second one of the at least four valve elements from the respective valve seat and a third, at rest position between the first and second positions with neither one of the first and second valve elements displaced from the respective valve seats, at least some of the valve lifters being operatively coupled with additional of the valve elements, respectively, such that at least one of the first and second, pivoted positions displaces two valve elements from the respective valve seats.

28. The bar gun of claim 27, one of the valve elements being a first syrup valve element and one of the additional valve elements being a carbonated or noncarbonated water valve element operatively coupled with the syrup valve element, there being lost motion in the operative coupling between the one of the valve lifters and the syrup valve element.

29. The bar gun of claim 27, the pivot axes of the actuators lying in a plane, the elongate direction of the handle being inclined to the plane, the handle and the actuators extending on the same side of the plane, the elongate direction of the handle lying at approximately 60 degrees from perpendicular to the plane, the first position of each actuator being pivoted away from the elongate handle and the second position of each actuator being pivoted toward the elongate handle.

30. A bar gun comprising a housing assembly including at least four valve seats, separate inlets to the valve seats and separate outlets from the valve seats;

at least four valve elements operatively mounted in the housing assembly and biased against the at least four valve seats, respectively;

actuators pivotally mounted relative to the housing assembly, each actuator being operatively coupled with a separate pair of the at least four valve elements, each actuator having a first, pivoted position displacing a first of the pair of valve elements from the respective valve seat, a second, pivoted position displacing a second of the pair of valve elements from the respective valve seat and a third, at rest position between the first and second positions with neither one of the pair of valve elements displaced from the respective valve seats, each of the actuators including a pivot mount, a lever extending from the housing assembly and two valve lifters, each valve lifter being operatively coupled with at least one of the valve elements, the lever and the valve lifters being pivotable together about the pivot mount, at least some of the levers being operatively coupled with additional of the at least four valve elements such that at least one of the first and second, pivoted positions displaces two valves from the respective valve seats.

31. The bar gun of claim 30 further comprising a spout coupled with each of the separate outlets;

an elongate handle mounting the housing assembly, the first position of each actuator being pivoted away from the elongate handle and the second position of each actuator being pivoted toward the elongate handle.

32. The bar gun of claim 31, the pivot axes of the actuators lying in a plane, the elongate direction of the handle being inclined to the plane, the handle and the actuators extending on the same side of the plane.

33. The bar gun of claim 32 further comprising a low-current electro-luminescent element disposed to at least partially surround the actuators on the housing assembly.

34. The bar gun of claim 33, the illuminating element being further disposed to illuminate the housing assembly at a position opposite to the extension of the elongate handle.

35. The bar gun of claim 34 further comprising light transmitting covers fixed to the housing assembly and covering the illuminating element.

36. A bar gun comprising a housing assembly including at least six syrup valve seats, a carbonated water valve seat, a noncarbonated water valve seat, separate inlets to the valve seats and separate outlets from the valve seats;

at least six syrup valve elements operatively mounted in the housing assembly and biased against the at least six valve seats, respectively;

a carbonated water valve element operatively mounted in the housing assembly and biased against the carbonated water valve seat;

a noncarbonated water valve element operatively mounted in the housing assembly and biased against the noncarbonated water valve seat;

actuators operatively mounted to the housing assembly, each actuator being operatively coupled with one or two of the at least six syrup valve elements and with one or the other or both of the carbonated water valve element and the noncarbonated valve element;

a first actuation plate over the carbonated water valve element;

a second actuation plate over the noncarbonated water valve element;

coupled with each of the syrup valve elements, respectively, and actuated by the associated actuator bars, each actuator bar having a first position extending to the first actuation plate to actuate the first plate along with the one syrup valve element and a second position extending to the second actuation plate to actuate the second plate along with the one syrup valve element.

37. A bar gun comprising a housing assembly including valve seats, separate inlets to the valve seats and separate outlets from the valve seats;

a carbonated water valve element operatively mounted in the housing assembly and biased against one of the valve seats;

a syrup valve element operatively mounted in the housing assembly and biased against another of the valve seats;

an actuator mounted relative to the housing assembly, the actuator operatively coupled with the carbonated water valve element and the syrup valve element and having a first position displacing the valve elements from the respective valve seats and a second position with the valve elements not displaced from the respective valve seats;

an actuator bar in the housing assembly, the carbonated water valve element and the syrup valve element operatively coupled with the actuator bar on one side of the actuator bar and the actuator operatively coupled with the actuator bar on the opposite side of the actuator bar, there being lost motion in the operative coupling between the actuator bar and the syrup valve element.

38. The bar gun of claim 37, the actuator bar being pivotally mounted in the housing assembly, the syrup valve element being operatively coupled with the actuator bar between the carbonated water valve element and the pivotal mounting of the actuator bar to the housing assembly.

39. The bar gun of claim 38 further comprising a plate spring between the actuator bar and the housing assembly biasing the actuator bar away from actuation of the carbonated water valve element.

40. A bar gun comprising a housing assembly including valve seats, separate inlets to the valve seats and separate outlets from the valve seats;

valve elements operatively mounted in the housing assembly and biased against the valve seats, respectively;

actuators mounted relative to the housing assembly, each operatively coupled with one or more of the valve elements;

a tube end piece fixed to the housing assembly and including first tube fittings arranged in a first pattern and in communication with the separate inlets, respectively;

a valve assembly remote from the tube end piece and including a flow control valve block, flow valves in the flow control valve block, separate inlet supply passages to the flow valves, respectively, separate outlet supply passages from the flow valves, respectively, and second tube fittings arranged in a second pattern being in communication with the separate outlet supply passages, respectively, the first and second patterns both being closely grouped.

41. The bar gun of claim 40 further comprising equal length tubes extending between and coupled with the respective first and second tube fittings of the first and second patterns.

42. The bar gun of claim 40 further comprising a flexible tube sheath fixed to the flow control valve block and fixed relative to the tube end piece at the ends of the flexible tube sheath, the tubes extending through the flexible tube sheath.

* * * * *